US008189840B2

(12) United States Patent
Guenther

(10) Patent No.: US 8,189,840 B2
(45) Date of Patent: May 29, 2012

(54) LOUDSPEAKER AND ELECTRONIC DEVICES INCORPORATING SAME

(75) Inventor: Godehard A. Guenther, Concord, MA (US)

(73) Assignee: Soundmatters International, Inc.

( * ) Notice: Subject to any disclaimer, the term of this patent is extended or adjusted under 35 U.S.C. 154(b) by 1346 days.

(21) Appl. No.: 11/752,400

(22) Filed: May 23, 2007

(65) Prior Publication Data

US 2008/0292117 A1 Nov. 27, 2008

(51) Int. Cl.
*H04R 9/06* (2006.01)

(52) U.S. Cl. ..... 381/332; 381/348; 381/333

(58) Field of Classification Search ..... 381/186, 381/351, 89, 332, 333, 334, 335; 181/156
See application file for complete search history.

(56) References Cited

U.S. PATENT DOCUMENTS

| | | | | |
|---|---|---|---|---|
| 2,551,447 | A | | 5/1951 | Marquis |
| 2,582,130 | A | | 1/1952 | Johnson |
| 2,769,942 | A | | 11/1956 | Hassan |
| 3,067,366 | A | | 12/1962 | Hofman |
| 3,340,604 | A | | 9/1967 | Parain |
| 3,838,216 | A | | 9/1974 | Watkins |
| 3,910,374 | A | | 10/1975 | Holehouse |
| 3,948,346 | A | | 4/1976 | Schindler |
| 3,979,566 | A | | 9/1976 | Willy |
| 3,984,346 | A | | 10/1976 | Gilliland |
| 4,076,097 | A | * | 2/1978 | Clarke ..... 181/147 |
| 4,122,315 | A | | 10/1978 | Schroeder et al. |
| 4,151,379 | A | | 4/1979 | Ashworth |
| 4,201,886 | A | | 5/1980 | Nagel |
| 4,220,832 | A | | 9/1980 | Nagel |
| 4,300,022 | A | | 11/1981 | Hastings-James et al. |
| 4,310,849 | A | | 1/1982 | Glass |
| 4,401,857 | A | | 8/1983 | Morikawa |
| 4,440,259 | A | | 4/1984 | Strohbeen |
| 4,472,604 | A | | 9/1984 | Nakamura et al. |
| 4,477,699 | A | | 10/1984 | Wada et al. |
| 4,492,826 | A | | 1/1985 | Chiu |
| 4,552,242 | A | | 11/1985 | Kashiwabara |
| 4,565,905 | A | | 1/1986 | Nation |
| 4,577,069 | A | | 3/1986 | Keezer |
| 4,737,992 | A | | 4/1988 | Latham-Brown et al. |
| 4,783,824 | A | | 11/1988 | Kobayashi |

(Continued)

FOREIGN PATENT DOCUMENTS

| | | | |
|---|---|---|---|
| CN | 1369190 | A | 9/2002 |

(Continued)

OTHER PUBLICATIONS

Electronic Circuits and Applications, Sentura et al., Massachusetts Institute of Technology, John Wiley and Sons, Inc., p. 22 (1975).

(Continued)

*Primary Examiner* — Davetta W Goins
*Assistant Examiner* — Amir Etesam
(74) *Attorney, Agent, or Firm* — Nutter McClennen & Fish LLP; David J. Powsner; Christopher J. Stow

(57) ABSTRACT

The invention provides, in some aspects, electronic devices with improved radiators (or "passive drivers") comprising an elastomerically mounted mass in order to improve sound reproduction fidelity. The mass comprises a component of the device not normally used for such purpose—e.g., a battery—thereby, permitting size reductions while, at the same time, enhancing audio fidelity.

10 Claims, 3 Drawing Sheets

U.S. PATENT DOCUMENTS

| | | | |
|---|---|---|---|
| 4,799,264 | A | 1/1989 | Plummer |
| 4,821,331 | A | 4/1989 | Murayama et al. |
| 4,965,837 | A | 10/1990 | Murayama et al. |
| 5,040,221 | A | 8/1991 | Edwards et al. |
| 5,070,530 | A | 12/1991 | Grodinsky et al. |
| 5,115,884 | A | 5/1992 | Falco |
| 5,143,169 | A | 9/1992 | Ziegenberg et al. |
| 5,155,578 | A | 10/1992 | Lim et al. |
| 5,333,204 | A | 7/1994 | Hamada et al. |
| 5,390,257 | A | 2/1995 | Oslac et al. |
| 5,402,503 | A | 3/1995 | Prokisch |
| 5,446,797 | A | 8/1995 | Paddock |
| 5,519,178 | A | 5/1996 | Ritto et al. |
| 5,524,151 | A | 6/1996 | Bleim |
| 5,548,657 | A | 8/1996 | Fincham |
| 5,583,945 | A | 12/1996 | Iijima et al. |
| 5,587,615 | A | 12/1996 | Murray et al. |
| 5,594,805 | A | 1/1997 | Sakamoto et al. |
| 5,604,815 | A | 2/1997 | Paddock |
| 5,625,699 | A | 4/1997 | Yamada |
| 5,625,701 | A | 4/1997 | Scanlan |
| 5,657,392 | A | 8/1997 | Bouchard |
| 5,715,324 | A | 2/1998 | Tanabe et al. |
| 5,715,775 | A | 2/1998 | Anderson |
| 5,744,761 | A | 4/1998 | Ogura et al. |
| 5,748,760 | A | 5/1998 | Button |
| 5,751,828 | A | 5/1998 | Ueda et al. |
| 5,802,189 | A | 9/1998 | Blodget |
| 5,802,191 | A | 9/1998 | Guenther |
| 5,835,612 | A | 11/1998 | Fujihira et al. |
| 5,847,333 | A | 12/1998 | D'Hoogh |
| 5,867,583 | A | 2/1999 | Hazelwood et al. |
| 5,894,524 | A | 4/1999 | Kotsatos et al. |
| 5,898,786 | A | 4/1999 | Geisenberger |
| 5,909,015 | A | 6/1999 | Yamamoto et al. |
| 5,909,499 | A | 6/1999 | Tanabe |
| 5,916,405 | A | 6/1999 | Ritto et al. |
| 5,917,922 | A | 6/1999 | Kukurudza |
| 5,937,076 | A | 8/1999 | Tanabe et al. |
| 5,960,095 | A | 9/1999 | Chang |
| 6,005,957 | A | 12/1999 | Meeks |
| 6,067,364 | A | 5/2000 | Brinkley et al. |
| 6,175,637 | B1 | 1/2001 | Fujihira et al. |
| 6,208,743 | B1 | 3/2001 | Marten et al. |
| 6,243,472 | B1 | 6/2001 | Bilan et al. |
| 6,269,168 | B1 | 7/2001 | Tagami |
| 6,343,128 | B1 | 1/2002 | Coffin |
| 6,359,997 | B2 | 3/2002 | Geisenberger et al. |
| 6,389,146 | B1 | 5/2002 | Croft, III |
| 6,418,231 | B1 | 7/2002 | Carver |
| 6,421,449 | B1 | 7/2002 | Hasegawa et al. |
| 6,611,606 | B2 | 8/2003 | Guenther |
| 6,654,476 | B1 | 11/2003 | Guenther |
| 6,704,426 | B2 | 3/2004 | Croft, III |
| 6,735,322 | B1 | 5/2004 | Watanabe |
| 6,778,677 | B2 | 8/2004 | Coffin |
| 6,876,752 | B1 | 4/2005 | Guenther |
| 6,993,147 | B2 | 1/2006 | Guenther |
| 7,006,653 | B2 | 2/2006 | Guenther |
| 7,302,076 | B2 | 11/2007 | Guenther |
| 7,532,737 | B2 | 5/2009 | Guenther |
| 7,653,208 | B2 | 1/2010 | Guenther |
| 2001/0043715 | A1 | 11/2001 | Geisenberger et al. |
| 2002/0150275 | A1 | 10/2002 | Guenther |
| 2003/0015369 | A1* | 1/2003 | Sahyoun ..... 181/157 |
| 2003/0044041 | A1 | 3/2003 | Guenther |
| 2003/0123692 | A1* | 7/2003 | Ueki ..... 381/398 |
| 2003/0228027 | A1 | 12/2003 | Czerwinski |
| 2004/0165746 | A1 | 8/2004 | Kreitmeier et al. |
| 2004/0231911 | A1 | 11/2004 | Welker et al. |
| 2005/0232456 | A1 | 10/2005 | Guenther |
| 2006/0159301 | A1 | 7/2006 | Guenther |
| 2006/0215870 | A1 | 9/2006 | Guenther |
| 2006/0215872 | A1 | 9/2006 | Guenther |
| 2006/0239492 | A1 | 10/2006 | Guenther |
| 2006/0239493 | A1 | 10/2006 | Guenther |
| 2007/0000720 | A1* | 1/2007 | Noro et al. ..... 181/156 |
| 2007/0127760 | A1* | 6/2007 | Saiki et al. ..... 381/351 |
| 2007/0201712 | A1* | 8/2007 | Saiki ..... 381/186 |
| 2008/0247582 | A1 | 10/2008 | Guenther |
| 2008/0292117 | A1 | 11/2008 | Guenther |
| 2009/0161902 | A1 | 6/2009 | Guenther |

FOREIGN PATENT DOCUMENTS

| | | | |
|---|---|---|---|
| CN | 1439235 | A | 8/2003 |
| CN | 1443433 | A | 9/2003 |
| DE | 19725373 | | 12/1998 |
| EP | 120587 | | 10/1984 |
| EP | 0622970 | | 11/1994 |
| EP | 0632675 | | 1/1995 |
| GB | 2311438 | | 9/1997 |
| JP | 1012795 | A | 1/1989 |
| JP | 10210587 | A | 8/1998 |
| JP | 2004-502365 | A | 1/2004 |
| WO | 00/30405 | A1 | 5/2000 |
| WO | 01/13677 | A1 | 2/2001 |
| WO | 02/01913 | | 1/2002 |
| WO | 02/01914 | | 1/2002 |
| WO | 2006/029378 | A2 | 3/2006 |

OTHER PUBLICATIONS

EP Search Report, EP Application No. 00954008, dated Mar. 25, 2009.

EP Search Report, EP Application No. 05795118.8, dated May 6, 2010.

* cited by examiner

LOUDSPEAKER AND ELECTRONIC DEVICES INCORPORATING SAME

BACKGROUND OF THE INVENTION

The invention relates to sound reproduction and, in particular, to improved loudspeakers and electronic devices incorporating same. It has application, by way of non-limiting example, in cell phones, personal digital assistants ("PDAs"), MP3 players, sound cradles, and other handheld, desktop or other small and/or low-powered apparatus.

Many speaker systems use dedicated components (e.g., woofers) for the reproduction of low frequency sound (e.g., bass), typically, for example, from about 40 Hz (or below) to about 200 Hz (or above). It is difficult for small and/or low-powered speakers of the type found in cell phones, PDAs, MP3 players, and other small electronic devices to reproduce those frequencies, especially at reasonable volumes. Indeed, because sounds in the mid-range frequencies are so much more efficiently generated, they tend to dominate small or low-powered speakers, making them sound "tinny."

The foregoing notwithstanding, there is increased demand for improved bass response in small devices and particularly, for example, small low-powered (e.g., battery-operated) devices. Current woofer designs do not adequately meet those needs. Most are too large for use in smaller devices, consume excessive power, and/or suffer extreme roll-off at low frequencies.

In view of the foregoing, an object of the invention is to provide improved loudspeakers and devices incorporating same. Another object is to provide improved apparatus and methods for sound reproduction and, specifically, for example, improved woofers. A related object is to provide such woofers as are suited for use in cell phones, PDAs, MP3 players, sound cradles, and other small and/or low-powered applications. A further object of the invention is to provide such woofers as can be produced at reasonable cost.

SUMMARY OF THE INVENTION

The foregoing are among the objects attained by the invention which provides, in some aspects, electronic devices with improved radiators (or "passive drivers") comprising an elastomerically mounted mass in order to improve sound reproduction fidelity. The mass comprises a component of the device not normally used for such purpose—e.g., a battery—thereby, permitting size reductions while, at the same time, enhancing audio fidelity.

In a further aspect of the invention, the elastomerically-mounted mass (e.g., battery) is air-coupled to one or more active drivers that are mounted within an enclosure. Those active drivers can be, for example, drivers for full-range speakers. The coupling can be provided, for example, by bores or apertures in the active drivers.

In further aspects of the invention, the elastomerically-mounted mass (e.g., battery) has a generally thin, planar configuration. This has the benefit of reducing the depth of the woofer and, thereby, of the enclosure as a whole while, at the same time, increasing the radiator size. In another related aspect of the invention, the radiator formed from the elastomerically-mounted mass has a surface area of about three times a surface area of the active driver, thereby enhancing bass response.

In still further aspects of the invention, the radiator is mounted on an outside wall (e.g., a rear wall) of the enclosure.

Still further aspects of the invention provides electronic devices as described above in which the elastomeric material used to mount the mass comprises rubber or other substance of suitable elasticity and acoustic properties. In a related aspect of the invention, the enclosure itself comprises metal, polymer, composite or other materials providing sufficient structural support and acoustic properties.

In a still further aspect of the invention, the mass (e.g., battery) and active drivers are mounted within a sealed enclosure, thereby improving audio fidelity by ensuring that air-coupling of the components is not degraded by, for example, air uncontrollably escaping the enclosure.

Other aspects of the invention provide a component (e.g., a battery) that has an elastomeric skirt adapted for mounting to an electronic device, e.g., to serve as a passive radiator as described above.

These and other aspects of the invention are evident in the drawings and in the description that follows.

BRIEF DESCRIPTION OF THE DRAWINGS

A more complete understanding of the invention may be attained by reference to the drawings, in which.

DETAILED DESCRIPTION OF THE ILLUSTRATED EMBODIMENT

Figure 1A:
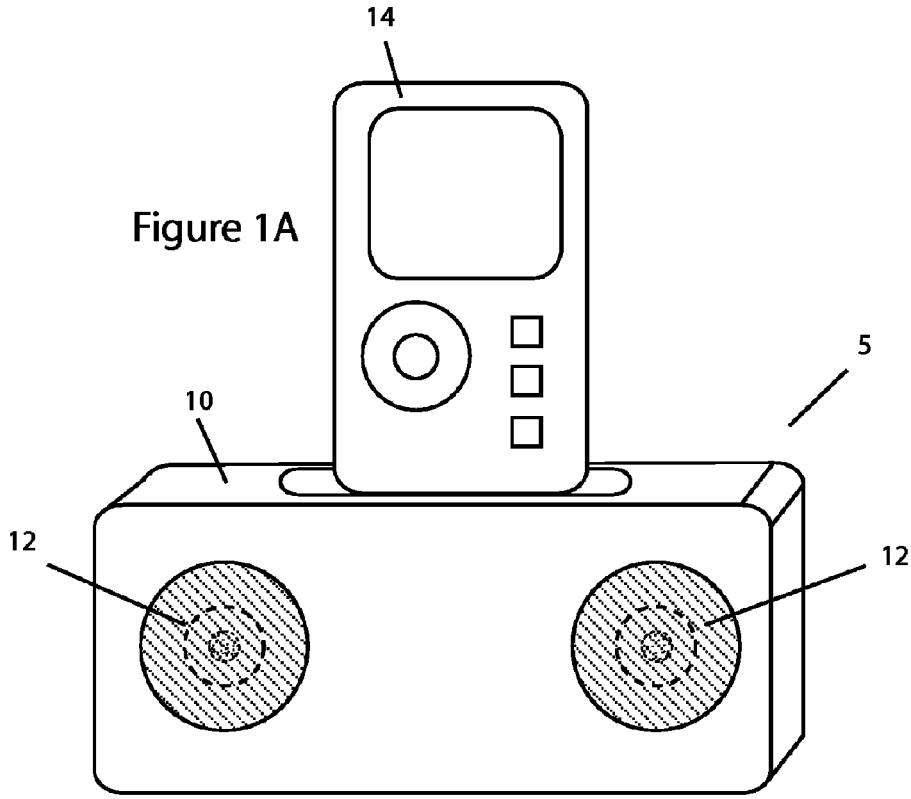
FIGS. 1A and 1B are front and rear perspective views, respectively, of an electronic device according to one practice of the invention.

FIG. 1A depicts an electronic device 5 according to one practice of the invention. That device 5 comprises a sound cradle, e.g., of the type to which an MP3 player 14 is coupled for reproduction of music or other sounds (pre-recorded or otherwise), although, in other embodiments, it may comprise another type of device wherein a speaker having a low power and right-sized footprint is desired, e.g., personal digital assistants (PDAs), cell phones, video game systems, and other handheld, desktop or other small and/or low-powered apparatus.

The illustrated sound cradle 5 includes an enclosure 10 having active drivers 12 configured as shown. Though two such drivers 12 are shown in the drawing, in other embodiments there may be varying numbers and configurations of such active drivers 12 (e.g., four linearly disposed active drivers). The enclosure 10 houses components of the sound cradle 5 (e.g., battery 40, active drivers 12, circuit board 31, etc., as discussed below), isolating them from the surrounding environment as per convention in the prior art of electronic device enclosures.

Illustrated enclosure 10 comprises a sealed plastic enclosure, e.g., of a volume of approximately 50 cc-300 cc, of the type commonly used for small handheld or desktop electronic devices. However, in other embodiments, it may be of other sizes and/or comprised of different materials (e.g., metal, ceramic, composites, etc.) of suitable rigidity for the requisite application. Preferably, enclosure 10 is substantially air-tight so as to improve air-coupling between the active drivers 12 and the radiator 34, as discussed below.

Active drivers 12 can be mid-range and/or high-frequency (tweeters) speakers of the type commonly known in the art and used for reproducing sounds of about 200-20,000 Hz for handheld, desktop or other small and/or low-powered apparatus. Preferred such drivers 12 are constructed in the manner disclosed in copending, commonly-assigned U.S. patent application Ser. No. 11/368,361, filed Mar. 3, 2006, and entitled "Low Profile Speaker and System," the teachings of which are incorporated herein by reference, though other drivers may be used instead and/or in addition.

Figure 1B:
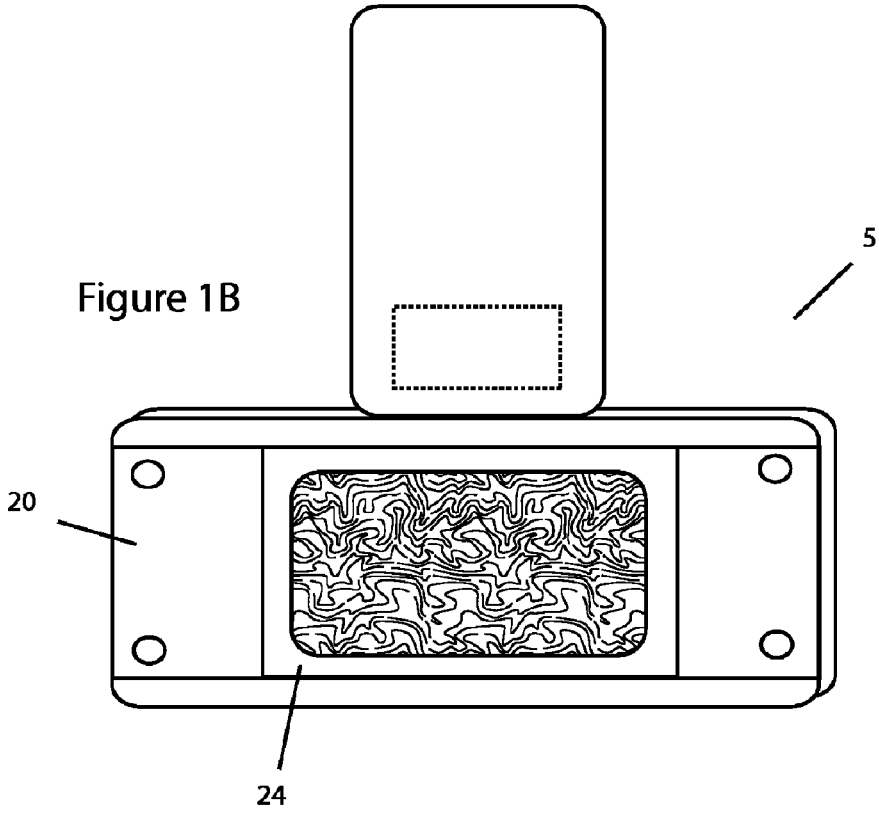

As shown in FIG. 1B, the illustrated device 5 includes a rear access panel 24 that permits a user (or a repair technician) to access a passive radiator 24 that enhances the reproduction of low-frequency sounds, e.g., sounds in the range of 40 Hz (or below) to about 200 Hz (or above), by device 5. Illustrated panel 24 can include an integral grill (not shown) that protects the operative portion of the radiator 24 from probing fingers or insult while, at the same time, facilitating propagation into the surrounding environment of sound waves generated by that radiator 34. Like enclosure 10, panel 24 of the illustrated embodiment is fabricated from plastic, metal, ceramic or other suitable materials known in the art. Although shown in the rear of enclosure 10, access panel 24 may be disposed elsewhere on the enclosure and, indeed, may be absent altogether—e.g., as in embodiments in which radiator 34 is directly accessible from outside the enclosure (without removal of a panel) or embodiments where no provision is made for access to the radiator 34.

Figure 2A:
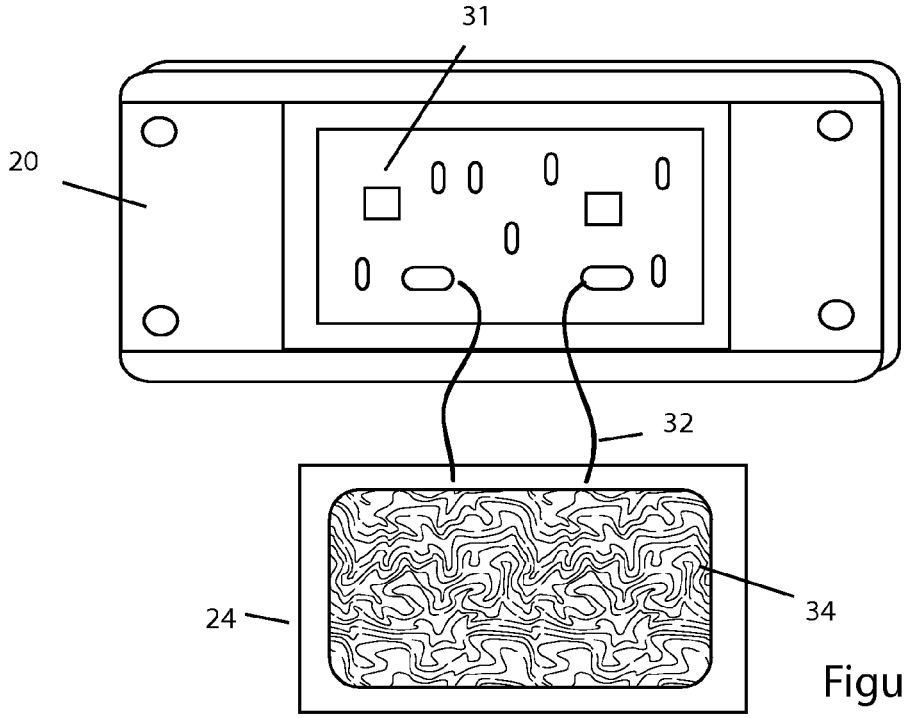
FIG. 2A is a rear perspective view of the electronic device of FIGS. 1A and 1B showing panel that includes a passive radiator according to the invention removed.

FIG. 2A is a rear view of the sound cradle 5, showing access panel 24 removed. Visible are the panel 24 (detached from enclosure 10), internal components 31, leads 32, and passive radiator 34. Components 31 comprise internal components of cradle 5. In the illustrated embodiment, these are depicted as a printed circuit board assembly of the type commonly employed in electronic devices to provide necessary signal generation and other electrical functions, though, in other embodiments, these may comprise discrete electrical components (e.g., power transformers), structural members of enclosure 10, and so forth, instead or in addition.

In the illustrated embodiment, leads 32 provide conductive connections from the aforementioned circuit board (or other electronics of device 5) to a battery that is contained in radiator 34 (as discussed below). Such electrical connection may be provided otherwise, in other embodiments of the invention. Thus, for example, in some embodiments, radiator 34 includes conductive tabs of the type generally known in the art that establish electrical connection between the battery and the circuit board upon attachment of the panel 24. Illustrated leads 32 also serve to tether the detached panel 24 to the device 5, although, that function may be provided otherwise (or not at all) in other embodiments.

Figure 2B:
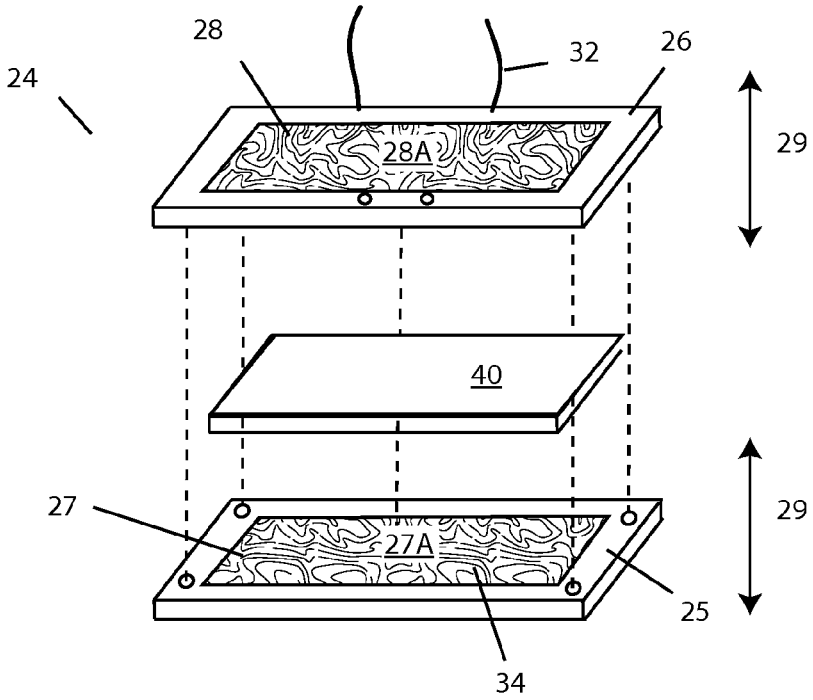
FIG. 2B depicts a construction of the passive radiator of FIG. 2A.

Passive radiator 34 comprises a mounting bracket 25, framing member 26, elastomeric membranes 27, 28, leads 32 and battery 40, configured as shown in the exploded schematic of FIG. 2B.

Battery 40 provides electrical power to the sound cradle 5 via battery leads 32 connected to the circuit board 31, while at the same time providing mass to the low-frequency sound-radiating portion of the radiator. In the illustrated embodiment, that battery 40 comprises a Lithium polymer cell (or cell array) having a flat, planar configuration, though, in other embodiments it may be sized, shaped and/or composed otherwise. Although a battery is employed in order to provide such mass, in alternative embodiments, other components of the device 5 (e.g., a circuit board, power transformer, etc.) may function as such, either in addition to, or instead of, the battery 40.

Elastomeric members 27, 28, along with battery (or other mass) 40, define the sound-radiating portion of radiator 34. Together, the trio of elements 27, 28 and 40 transfer lower-frequency sound waves—generated, in the first instance, by the active drivers 12—from within the enclosure 10 to the environment outside the enclosure. In the illustrated embodiment, the battery 40 is sandwiched (or otherwise tightly coupled) between the elastomeric members 27, 28 such that the trio of elements 27, 28 and 40 oscillate or otherwise move together. A cavity in the enclosure 10, e.g., in the region between panel 24 and circuit board (or other components) 31, provides sufficient space to permit such movement.

In the illustrated embodiment, members 27 and 28 comprise rubber or other elastomeric sheets that are affixed, along the periphery of respective radiating regions 27A, 27B to mounting bracket 25 and framing member 26, respectively, as shown. A pocket, hook-and-loop, fastener or other member (not shown) can be provided in one or both of the members 27, 28 to more securely hold the battery at or near the centers of those regions 27A, 27B, e.g., so that the batter does not shift, e.g., during transport, or as a result of gravity, jolt, shock or other motion or force, transversely to the axis 29 of oscillatory motion of the aforesaid trio. While members 27, 28 of the illustrated embodiment comprise rubber other elastomeric sheets, it will be appreciated that other structures and/or compositions, e.g., of the type otherwise used or suitable for passive radiator construction (and with sufficient strength and/or reinforcement to accommodate battery 40) may be used instead or in addition.

Mounting bracket 25 and framing member 26 comprise plastic, metal, ceramic or other structures suitable for retaining the elastomeric members 27, 28, along with battery (or other mass) 40 as described above. These can be fabricated in a configuration of the sort shown in FIG. 2B or otherwise suitable for the aforesaid purpose. Consistent with the discussion above, mounting bracket 25 can include a grill on its obverse side, e.g., to damage from probing fingers or otherwise, as discussed above. Framing member 26 are coupled to leads 26, as shown, so as to insure that there is electrical connectivity between the battery 40 and the circuit board 31 (or other internal components of device 5), when the panel 24 and radiator 34 are assembled and/or reattached for operation.

Although, in the illustrated embodiment, battery 40 is discrete from (but suitable for assembly with) elastomeric members 25, 26, in other embodiments these can be integral members. Thus, for example, battery 40 can include an integral rubber or other elastomeric skirt (not shown) that is suitable for affixation, e.g., by hook-and-loop, fastener or other mechanism to the enclosure 10, e.g., in place of (or in addition to) panel 24. The skirt, moreover, need not be integral to the battery but, instead, could be configured for affixation to the battery itself, again, by hook-and-loop, fastener or other mechanism.

Figure 3:
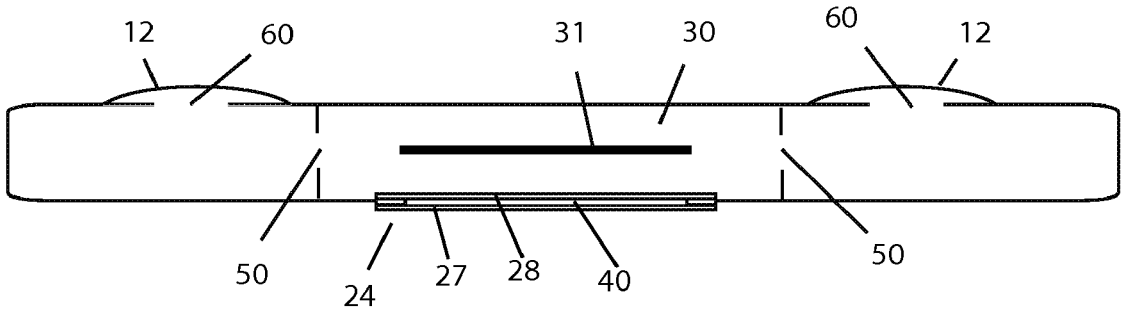
FIG. 3 depicts a cross-sectional view of the electronic device of FIGS. 1A-2B.

FIG. 3 is a top-down cross-sectional view of the sound cradle 5. In the illustrated embodiment, the passive radiator 34 is air-coupled to the active drivers 12, e.g., via two bores 50 within the enclosure. In embodiments utilizing drivers 12 constructed in accord with aforementioned incorporated-by-reference U.S. patent application Ser. No. 11/368,361, additional coupling is provided via central bores 60 within the drivers 12 themselves. In operation, sound waves contained in backpressure generated by the active drivers 12 propagate within the enclosure 10 to the passive radiator 34, causing it to transmit low-frequency sound to the surrounding environment.

As those skilled in the art will appreciate, cradle 5 is capable of reproducing sound at lower frequencies and higher-fidelity than traditional small and/or low-powered electronic devices. This is a function of the surface area, mass and compliance of the sound-radiating portion of the radiator

34. By using a battery 40 as part of its mass, the radiator effectively extends the low-frequency response (or "bass response") of the active drivers 12 beyond that of traditional speaker systems in small enclosures. This is further aided, in the illustrated embodiment, by use of rubber or other heavier-weight elastomeric material in members 27, 28.

A radiator 34 according to a preferred practice of the invention, moreover, has an overall surface area that is three times greater than each of the active drivers 12. This enhances air-coupling, and thus enhanced sound fidelity and bass response characteristics, with minimal travel of the woofer 40 (e.g., a few millimeters). Traditional radiator woofers typically require a greater travel length (e.g., because of a small mass), thereby requiring a substantially larger enclosure to achieve similar frequency response, which is not suitable for most cell phones, PDAs, sound cradles, and other handheld, desktop or other small and/or low-powered apparatus.

Those skilled in the art will appreciate that the embodiments disclosed herein are merely examples of the invention and that other embodiments, incorporating changes thereto, fall within the scope of the invention, of which, I claim:

1. An electronic device comprising an enclosure, one or more active speakers mounted in the enclosure for radiating sounds in a first frequency range, each speaker having an active driver, a woofer comprised of a mass elastomerically mounted in a wall of the enclosure and air-coupled to one or more of the speakers, wherein the mass comprises a battery of the device in order to reduce the size of the woofer and/or the enclosure while, at the same time, enhancing audio fidelity of the active drivers.

2. The electronic device of claim 1, wherein the first frequency range comprises frequencies over 200 Hz.

3. The electronic device of claim 1, wherein the woofer radiates sound waves in a frequency range below 200 Hz.

4. The electronic device of claim 1, wherein the woofer is air-coupled to the active speakers through one or more bores in said enclosure.

5. The electronic device of claim 1, wherein the battery has a flat and/or planar shape.

6. The woofer of claim 1, wherein woofer has an oscillating portion whose surface area is at least three times greater than a surface area of one or more of the speakers.

7. The electronic device of claim 1, wherein the woofer comprises a diaphragm weighted with a battery.

8. The electronic device of claim 1, wherein a plurality of such woofers are disposed within the enclosure and air-coupled to one or more of the speakers.

9. The woofer of claim 1, wherein the enclosure is substantially air-sealed in order to facilitate said air-coupling.

10. The woofer of claim 1, wherein a volume of the enclosure is between 50 cc and 300 cc.

* * * * *